United States Patent [19]

Greiner et al.

[11] 4,397,236

[45] Aug. 9, 1983

[54] INKING UNIT WITH TRAVERSING INK ROLLERS

[75] Inventors: Harry M. Greiner, Offenbach am Main; Roland Höll, Weiterstadt; Klaus Neberle, Heusenstamm; Paul Abendroth, Offenbach am Main, all of Fed. Rep. of Germany

[73] Assignee: M.A.N.-Roland Druckmaschinen Aktiengesellschaft, Fed. Rep. of Germany

[21] Appl. No.: 293,445

[22] Filed: Aug. 17, 1981

[30] Foreign Application Priority Data

Sep. 13, 1980 [DE] Fed. Rep. of Germany ..... 3034644

[51] Int. Cl.[3] ..... B41F 31/14; B41L 27/16

[52] U.S. Cl. ..... 101/350; 101/DIG. 14

[58] Field of Search ..... 101/DIG. 14, 348, 349, 101/350, 351, 352, 148, 330, 340, 341, 342, 345-347, 205, 206, 207-210

[56] References Cited

U.S. PATENT DOCUMENTS

| | | | |
|---|---|---|---|
| 2,242,214 | 5/1941 | Huck | 101/DIG. 14 |
| 3,815,498 | 6/1974 | Harrod | 101/DIG. 14 |
| 3,983,812 | 10/1976 | Schramm | 101/DIG. 14 |
| 4,170,176 | 10/1979 | Domeniconi | 101/349 X |
| 4,295,423 | 10/1981 | Johne et al. | 101/349 |

*Primary Examiner*—J. Reed Fisher

*Attorney, Agent, or Firm*—Leydig, Voit, Osann, Mayer & Holt, Ltd.

[57] ABSTRACT

An inking unit for a printing press including a source of ink, a set of ink transfer rollers for establishing an ink film, a distributor roller vibrated endwise for distribution of the ink film and a form roller for applying the ink film to a plate on the plate cylinder. The form roller has a shaft and an outer cylindrical shell, the latter being rotated by surface engagement. A bearing between the shaft and the shell permits relative axial as well as rotational movement. A cam of the cylindrical, or drum, type mounted on the shaft has an endless wavy groove in which is received a cam follower in the form of a roller extending radially inwardly from the sleeve so that the sleeve reciprocates through a single cycle as a result of a single relative rotation of the shaft. The shaft is driven at a speed which causes the frequency of vibration of the form roller to differ from the frequency of vibration of the distributor roller so that the ghost image on the form roller is constantly being displaced and dissipated both peripherally and axially with respect to the image on the plate resulting in substantially ghost-free printing. A clutch is provided for remote switching between two modes of operation.

3 Claims, 10 Drawing Figures

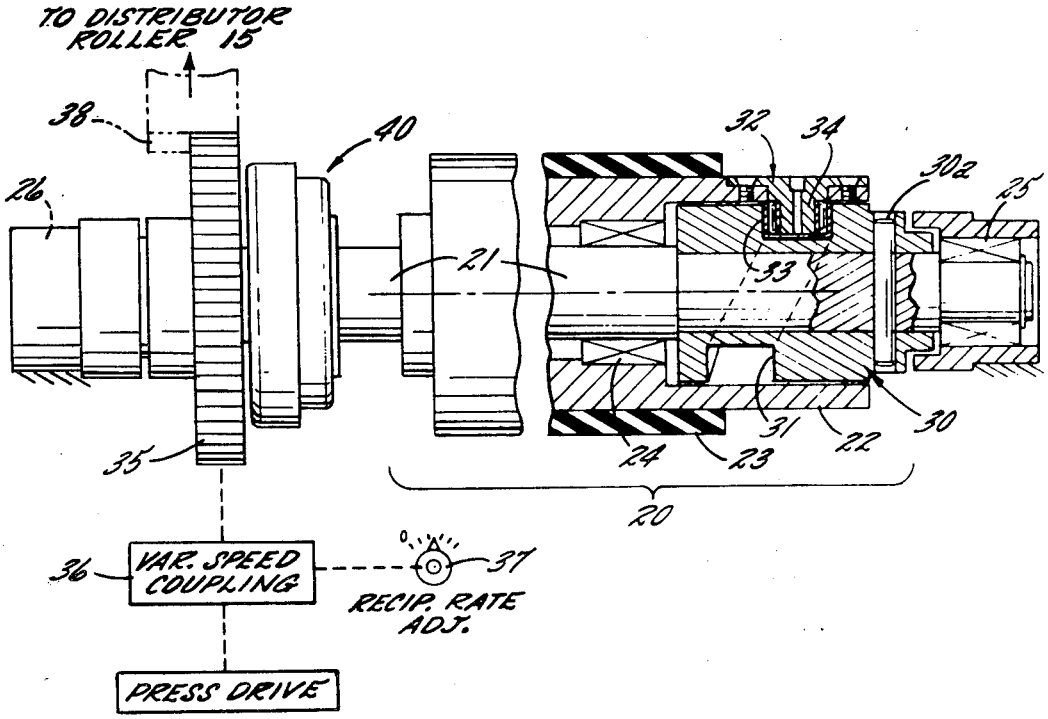

INKING UNIT WITH TRAVERSING INK ROLLERS

Efforts have been made over the years to produce an inking unit for a printing press which establishes an ink film, for application to the plate, which is uniform and which is tailored to the requirements of each zonal, or column, position. However, in the case of the most sophisticated designs of inking units "ghosting" is still a problem.

Ghosting results from the fact that as the form roller rolls in contact with the printing plate, ink is not removed uniformly from the form roller but is removed in the pattern of the ink image on the plate. This creates, on the return side of the form roller, a negative ghost image which is brought into contact with successive areas on the plate during successive revolutions of the form roller. Thus the ghost image on the form roller, which is displaced peripherally with respect to the image on the plate, produces a ghost image on the printed product which can be identified as a pattern of adjacent areas which are slightly over or slightly under inked.

In an effort to eliminate the ghost-producing image on the return side of the fountain roller, resort has been had to the use of a doctor blade extending the full length of the form roller, on its return side, to prevent re-circulation of the ink pattern which produces the ghost. However, use of a doctor blade on the form roller is not a practical solution because of the wear which occurs in the soft covering of the form roller and because of the problem of collecting the scraped-off ink. More practical efforts at solution have involved use of a distributor roller in contact with the form roller vibrated endwise through a small displacement to break up the pattern of returned ink on the form roller. However, this is only partially effective since at least a portion of the ink on the return side of the form roller remains in place on the feed side for application to the plate.

Nor is the situation improved by long stroke vibration of a distributor roller as shown in German publication DE-OS No. 1 611 196. In addition, production of the long stroke requires elaborate gearing, and results in mounting complications and high expense making the construction unsuited for purposes of retrofit. Another example of a vibrated distributor roller is to be found in German document DE-OS No. 2 045 717, but such construction is not suitable since the space inside the tubular body, or shell, is too restricted.

It is, accordingly, an object of the present invention to provide an inking unit which produces high quality substantially ghost-free printing but which is simple and inexpensive and which is well suited for retrofit installation in presses of existing design or which are already in the field.

It is a more specific object of the present invention to provide an inking unit for a printing press which includes a vibrated distributor roller and a vibrated form roller with the form roller being vibrated at a frequency which differs from the frequency of vibration of the distributor roller so that the ghost image on the form roller is constantly being displaced and dissipated both peripherally and axially with respect to the image on the plate.

It is another specific object to provide a vibrated form roller which is highly compact and which uses a shaft fittable into conventional form roller mounts, the form roller having a shaft and shell with a cam of the cylindrical, or drum, type interposed between them resulting in vibration of the shell upon relative rotation of the shaft.

In one of the aspects of the invention it is an object to provide a form roller having a shell rotated by surface engagement, a driven shaft and a clutch having a first mode in which the shaft of the form roller is coupled to the shell for rotation thereof in unison free of reciprocation and a second mode in which the shaft of the form roller is coupled to the press drive for rotation at a relative speed which produces reciprocation of the shell with respect to the shaft.

Other objects and advantages of the invention will become apparent upon reading the attached detailed description and upon reference to the drawings in which.

Figure 2:
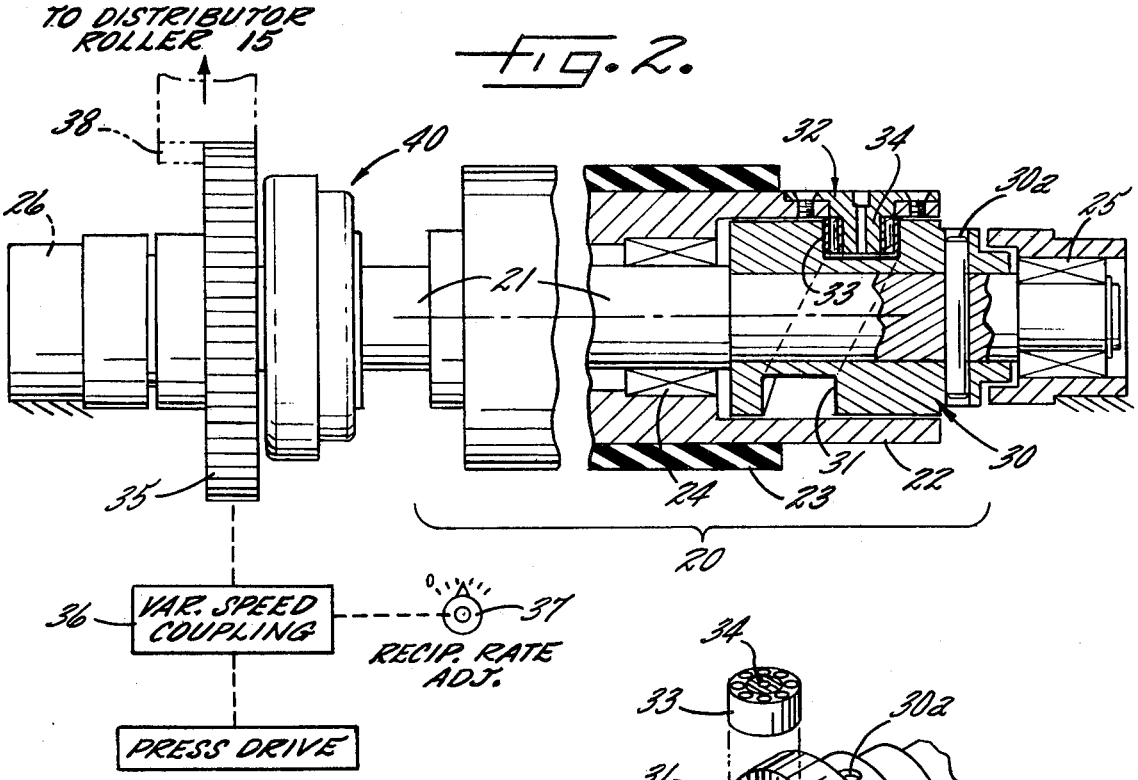
FIG. 2 shows a form roller, foreshortened, with one end sectioned to reveal the cam and cam follower employed to achieve vibratory movement.
Figure 2A:
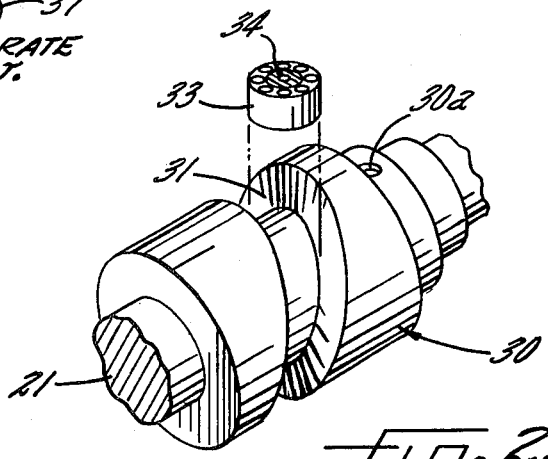

FIG. 2*a* is a fragmentary perspective view of the cam and its follower.

Figure 3:
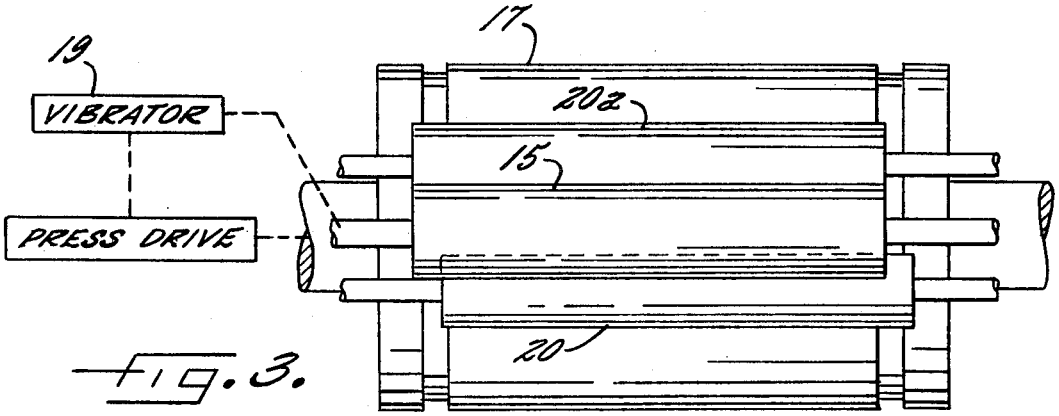
Figure 4:
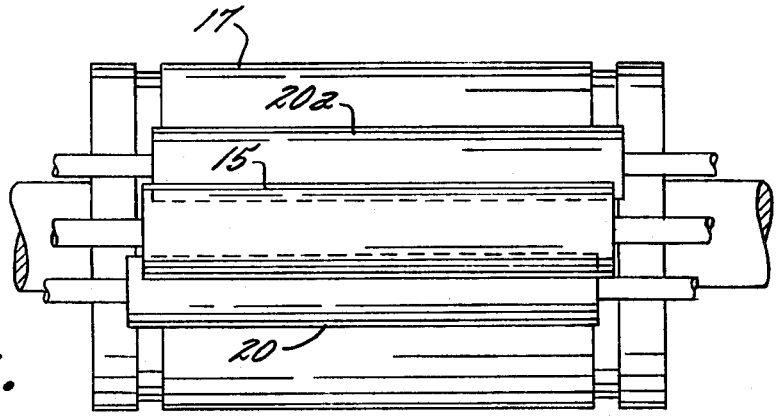
Figure 5:
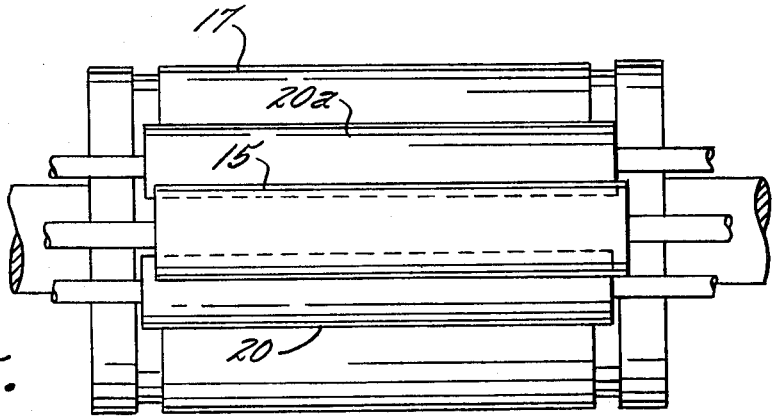

FIGS. 3, 4 and 5 are stop motion views showing the relative positions of a vibrated distributor roller and its two adjacent form rollers.

Figure 6:
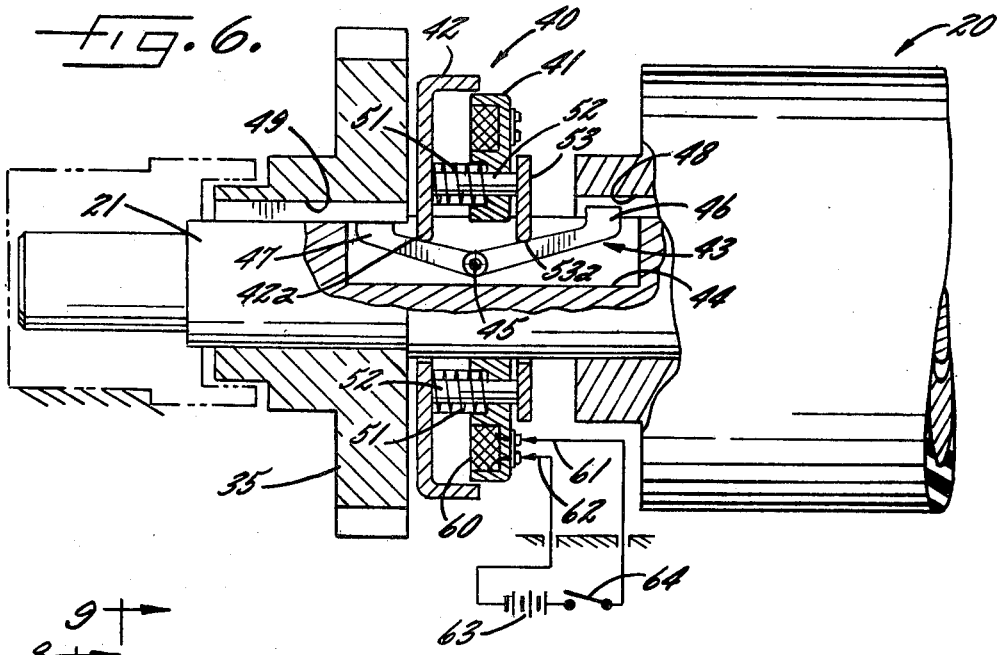

FIG. 6 is a sectional view showing use of a clutch at one end of the form roller, the clutch having both reciprocatory and non-reciprocatory modes.

Figure 7:
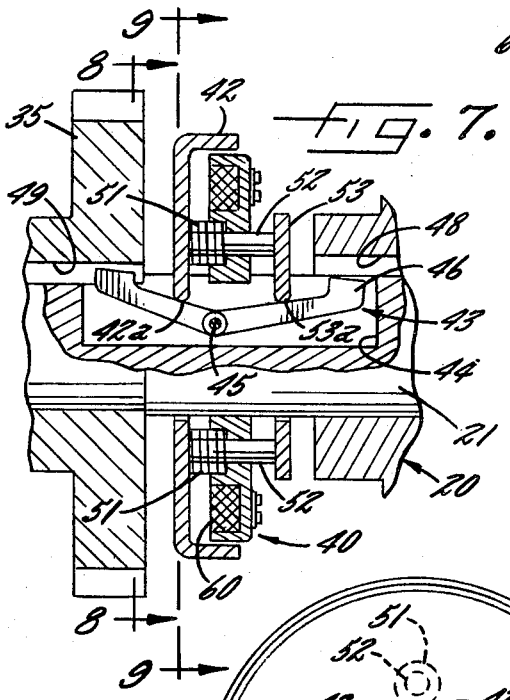

FIG. 7 shows the clutch mechanism of FIG. 6 in the reciprocatory mode.

Figure 8:
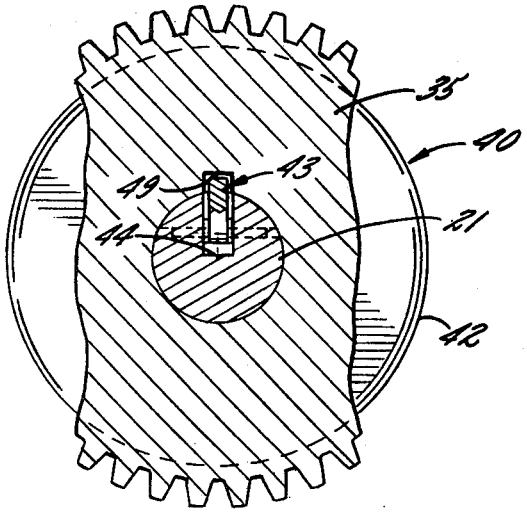

FIG. 8 is a fragmentary section looking along line 8—8 in FIG. 7.

Figure 9:
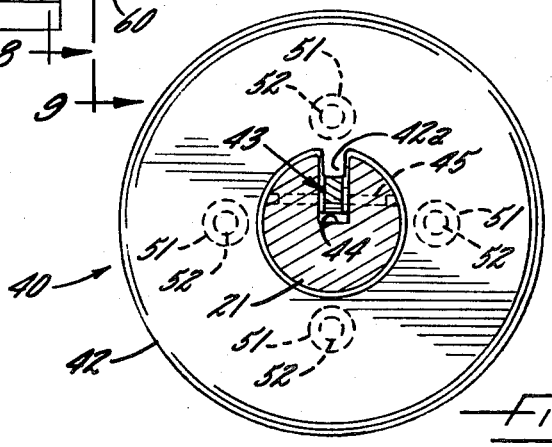

FIG. 9 is a fragmentary section looking along line 9—9 in FIG. 7.

While the invention has been described in connection with certain preferred embodiments, it will be understood that we do not intend to be limited to the particular embodiments shown but intend, on the contrary, to cover the various alternative and equivalent constructions included within the spirit and scope of the appended claims.

Figure 1:
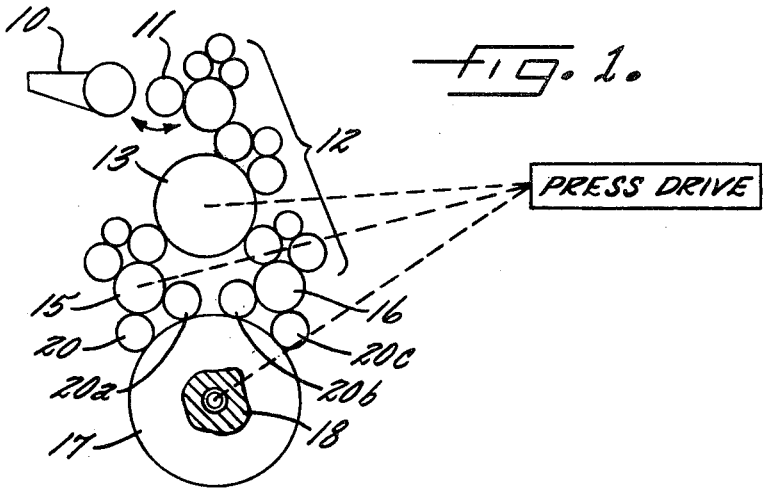
FIG. 1 is a schematic elevation of an inking unit in an offset press employing the present invention.

Turning now to FIG. 1 there is shown schematically, and in elevation, an inking unit consisting of a series of film-forming rollers characteristic of a modern lithograph press. A source of ink is provided in the form of a fountain 10 from which ink is fed by a ductor 11 through a series of transfer rollers 12 including an ink drum 13 and a pair of distributor rollers 15, 16.

Interposed between the distributor rollers 15, 16 and the plate cylinder 17 of the press, which are journaled in the press frame 18, are paired form rollers 20, 20*a* and 20*b*, 20*c*, respectively. With the plate cylinder 17 rotated in the direction of the arrow, that is, counterclockwise, the form roller 20 occupies the "downstream" position.

As thus far described, the operation of the inking unit is conventional, the ink fountain roller and various ones of the rollers including the drum 13 and distributor rollers 15, 16 being directly coupled to the press drive, the same drive which drives the cylinders of the press. The distributor rollers 15, 16, in addition to being rotated, are vibrated endwise by conventional vibrators such as the vibrator 19 indicated diagrammatically in FIG. 3.

In accordance with the present invention at least the "downstream" form roller 20 is provided with means for vibrating the same endwise at a frequency which differs from the frequency of vibration of the associated distributor roller 15 so that the ghost image on the form roller is constantly being displaced and dissipated both peripherally and axially with respect to the image on the plate. More specifically in accordance with the present invention at least one other of the form rollers is also vibrated at a frequency which differs from the frequency of its associated distributor roller. To achieve the vibration of the form rollers, each of the vibrated form rollers has a shaft and an outer cylindrical shell, the shell being rotated in surface engagement, and with a bearing between the shaft and the shell permitting relative rotational and endwise movement. A cam and cam follower interposed between the shaft and the shell serve to vibrate the shell back and forth as the shaft rotates within it.

Thus, referring to FIG. 2, the form roller 20 is shown foreshortened and in partial section. The form roller includes a central shaft 21 and an outer shell 22 in the form of a tube covered with a resilient layer 23. Interposed between the shaft 21 and the shell 22 is a bearing 24 which permits relative rotational and endwise movement of the shell with respect to the shaft. The ends of the shaft 21 are supported in the frame in bearings 25, 26, respectively.

For the purpose of vibrating, that is, reciprocating, the shell 22 of the form roller upon relative rotation of the shaft 21, there is, mounted upon one end of the shaft a cam 30 of the cylindrical, or drum, type, formed as a cylindrical collar held in place by a pin 30*a* and having an endless wavy groove 31 formed in its outer surface. Extending radially inwardly into the groove is a cam follower 32 made up of an anti-friction roller 33 mounted on a radially oriented pin or projection 34 secured to the adjacent end of the sleeve 22. The cam groove 31 provides a single cycle of reciprocation for each relative rotation of the shaft 21.

For the purpose of driving the shaft 21 a spur gear 35 is mounted at the opposite end of the shaft, the spur gear being coupled to the press drive by means of a variable speed coupling 36 having a manually settable control 37 for varying the drive ratio. Adjustable variable speed couplings are available on the market in conventional design so the details of such a coupling need not be disclosed.

It will be apparent that when the shell is driven at so-called "press" speed by surface, or frictional, engagement, adjusting the control 37 to rotate the shaft 21 at the same speed, and in the same direction, as the shell, will produce a condition of zero relative motion between the cam 30 and cam follower roller 32 so that the form roller will rotate but not reciprocate. Offsetting the adjustment of the control 37 to produce a shaft speed which differs from that of the shell speed will cause relative motion of the cam with respect to the follower to produce endwise vibration of the shell at a rate which is equal to the speed differential. The operator of the press adjusts the speed of the shaft 21 to produce a rate of reciprocation which differs from the rate of endwise vibration of the associated distributor roller 15. Preferably the rate of vibration of the form roller is higher than that of the distributor roller.

Alternatively, the spur gear 35 which drives the shaft 21 may be meshed with a second spur gear 38 (FIG. 2) which is mounted on the shaft of the distributor roller 15, the ratio between the gears 35, 38 being such as to produce a rate of endwise vibration of the form roller shell which differs, in predetermined ratio, from the rate of vibration of the distributor roller.

Because of the wide disparity in diameter of the form roller 20 and plate cylinder 17, the ghost image on the form roller is constantly being displaced peripherally with respect to the image on the plate. In short, the ghost image picked up by the form roller at one portion of the plate will be re-applied to the plate at a point downstream of its length to show up on the printed product. It is found that by providing a vibrated form roller operating at a rate of endwise vibration which differs from the rate of vibration of the associated distributor roller, the ghost image on the form roller is not only displaced peripherally but displaced and dissipated axially with respect to the image on the plate so that ghosting is not noticeable in the printed product.

The effect of using a vibrated form roller is most noticeable where the form roller which is vibrated occupies the final or downstream position 20 as illustrated in FIG. 1. However, in accordance with the invention, a vibrated form roller, constructed as illustrated in FIG. 2, should preferably be employed at at least one other form roller position; that is, at least one of the other form rollers 20*a*, 20*b*, 20*c* should be actively vibrated along with the form roller 20 and at a rate of vibration which differs from the rate of vibration of the associated distributor roller 15 or 16.

Where both of the form rollers 20, 20*a* associated with the distributor roller 15 are vibrated in accordance with the above, it will be apparent that the ghost images on the return side of the form rollers are effectively dissipated by the combined effects of the endwise vibration of the rollers in the cluster at different rates. This has been graphically illustrated in the stop motion views of FIGS. 3, 4 and 5.

It has already been stated that the form roller 20, illustrated in FIG. 2, can be operated in two modes depending upon the setting of the speed, or ratio, control 37. That is, by adjusting the control so that the speed of the form roller shaft 21 is the same, and in the same direction, as the speed of the frictionally driven shell, there is no relative movement of the cam with respect to the cam follower and the shell rotates but does not reciprocate. By offsetting the adjustment of the control 37 to produce a differential speed of the shaft reciprocation is produced.

As a convenient means for remotely achieving both of the modes at the option of the press operator, free of any adjustment of the speed control, a clutch mechanism may be employed as illustrated in FIG. 6. Such clutch mechanism, indicated generally at 40, may be mounted upon the shaft 21 between the end of the shell 22 and the adjacent spur gear 35. The clutch, as illustrated, is of the electromagnetic type in which there is an axially fixed disc 41 and an axially movable disc 42 which acts upon a clutch dog to move it between alternate positions to achieve respective modes of operation. The clutch dog, generally indicated at 43, is recessed in a slot 44 formed in the shaft and is centrally pivoted, at 45, to define a first arm 46 and a second arm 47 which register with internal axial grooves 48, 49 formed in the roller shell 22 and in the spur gear 35, respectively.

Under the "mode I" condition the two portions of the clutch 41, 42 are spread apart by means of a set of coil springs 61 encircling respective posts 52 which are mounted on an annular yoke plate 53. Under such conditions tangs 42*a*, 53*a*, which extend radially inwardly into the grooves 44 cause the clutch dog 43 to be rocked into the illustrated counterclockwise position in which the arm 46 mates with the groove 48 in the shell, while the arm 47 is disengaged from the groove 49 in the spur gear. This locks the shaft 21 to the shell 22 so that they rotate in unison without producing any relative reciprocating movement.

For the purpose of attracting the clutch disc 42 inwardly to switch the clutch dog 43 into its opposite condition, the clutch disc 41 preferably has a magnetic winding 60 brought out to slip ring terminals 61, 62 which are energized by a source of current 63 under the control of a switch 64.

Thus, closing the switch energizes the coil 60, attracting the disc 42 into the condition illustrated in FIG. 7 and causing the clutch dog 43 to rock to its alternate condition in which the arm 47 mates with the groove 49 in the spur gear and the arm 46 is withdrawn from the groove 48 in the shell. Under such condition the shaft 21 is positively driven by the spur gear (see also FIG. 8) at a differential speed with respect to the speed of the frictionally driven shell resulting in relative movement at the cam and reciprocation of the shell.

The mechanism can be restored to its original mode of operation by opening the switch 64 which de-energizes the coil 60, with the force stored in the springs 51, acting upon tine 42*a*, being sufficient to cam the clutch dog 43, thereby restoring the condition illustrated in FIG. 6. In short the invention may be selectively brought into operation by the simple throwing of a switch.

It is apparent that the construction described above amply fulfills the objects of the invention: Form rollers of the type shown, and operated as described, bring about a substantial improvement in printing quality by the substantial elimination of ghosting, yet the structure is compact and inexpensive making it ideally suited to retrofit of the inventive feature in form roller sockets of presses of existing design, even presses already in the field.

We claim as our invention:

1. In an inking unit for a printing press having a frame and a plate cylinder journaled therein as well as a press drive, the combination comprising a source of ink, a set of ink transfer rollers for establishing an ink film, a pair of distributor rollers for receiving the ink film from the transfer rollers, means for vibrating the distributor rollers endwise, a pair of form rollers interposed between each of the distributor rollers and the plate on the plate cylinder, the form rollers being rotated by surface engagement, the form roller which is in downstream position and at least one of the other form rollers having means for vibrating the same endwise so that the ghost image on such vibrated form rollers is constantly being displaced and dissipated both peripherally and axially with respect to the image on the plate, the vibrated ones of the form rollers being vibrated at a frequency which differs from the frequency of vibration of the associated distributor roller.

2. In an inking unit for a printing press having a frame and a plate cylinder journaled therein as well as a press drive, the combination comprising a source of ink, a set of ink transfer rollers for establishing an ink film, a distributor roller having means for vibrating the same endwise for distribution of the ink film, and a form roller for applying the ink film to a plate on the plate cylinder, the form roller having a shaft journaled in the frame and having an outer cylindrical shell, the shell being rotated by surface engagement, a bearing between the shaft and the shell for permitting relative axial as well as rotational movement, a cam and cam follower interposed between the shaft and the shell, the cam being of the cylindrical or drum type causing the shell to be vibrated endwise so that the ghost image thereon is constantly being displaced and dissipated both peripherally and axially with respect to the image on the plate, and means for driving the shaft at a speed which causes the frequency of vibration of the form roller to differ from the frequency of vibration of the distributor roller.

3. In an inking unit for a printing press having a frame and a plate cylinder journaled therein as well as a press drive, the combination comprising an ink fountain, means including a transfer roller for accepting ink from the fountain and for establishing an ink film, a distributor roller coupled to the transfer roller and having means for vibrating the same endwise for distribution of the ink film, a form roller in rolling engagement with the distributor roller for applying the ink film to a plate on the plate cylinder, the form roller having a shaft journaled in the frame and having an outer cylindrical shell, the shell being rotated by surface engagement with the distributor roller and the plate on the plate cylinder, a bearing between the shaft and the shell for permitting relative axial as well as rotational movement, a cam and cam follower interposed between the shaft and the shell, the cam being of the type causing the shell to vibrated endwise upon relative movement of the cam and cam follower so that the ghost image thereon is constantly being displaced and dissipated both peripherally and axially with respect to the image on the plate, an auxiliary drive coupled to the press drive, alternatively actuated clutch elements for (a) coupling the shaft and the shell of the form roller for operation of the shell in a nonvibratory mode and for (b) coupling the shaft of the form roller to the auxiliary drive for operating the shell in the vibratory mode set forth.

* * * * *